US005621916A

United States Patent [19]

Bell

[11] Patent Number: 5,621,916

[45] Date of Patent: Apr. 22, 1997

[54] BIB FOR USE WHILE OPERATING A VEHICLE

[76] Inventor: Carol W. Bell, 1618 Dawnville Rd., Dalton, Ga. 30721

[21] Appl. No.: 611,270

[22] Filed: Mar. 5, 1996

[51] Int. Cl.[6] ..... A41B 13/10; A41D 1/00

[52] U.S. Cl. ..... 2/48; 2/52

[58] Field of Search ..... 2/48, 49.3, 52, 2/2

[56] References Cited

U.S. PATENT DOCUMENTS

| | | | |
|---|---|---|---|
| 115,238 | 5/1871 | Raiford | 2/52 X |
| 2,154,464 | 4/1939 | Lozier | 2/52 X |
| 2,421,195 | 5/1947 | Goldsmith | 2/52 X |

*Primary Examiner*—C. D. Crowder
*Assistant Examiner*—Shirra L. Jenkins

[57] ABSTRACT

Bib specifically adapted to be worn while an operator is controlling a vehicle. The device defines particular application while a user is eating and/or drinking while operating a vehicle. In its broadest context, the device includes a sheet of material having a first and a second end and an intermediate extent therebetween, wherein the intermediate extent is of a greater width than the first and second ends. Furthermore, a first steering column ring is adapted to be secured to the first end of the sheet while a neck ring is adapted to be secured adjacent the second end of the sheet. Thus, in operation, the user affixes the neck ring about the neck and the steering column ring about the steering column of a vehicle and thus employs the sheet as a bib.

4 Claims, 3 Drawing Sheets

BIB FOR USE WHILE OPERATING A VEHICLE

BACKGROUND OF THE INVENTION

1. Field of the Invention

The present invention relates to a bib for use while operating a vehicle and, more particularly, pertains to providing a bib for use while operating a vehicle.

2. Description of the Prior Art

The use of aprons of various designs and configurations are known in the prior art. More specifically, aprons of various designs and configurations heretofore devised and utilized for the purpose of protecting garments through various methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. 4,660,224 to Ashcraft; U.S. Pat. No. 3,470,566 to Battaglia et al; U.S. Pat. No. Des. 307,070 to Wymer; U.S. Pat. No. Des. 301,382 to Meade; U.S. Pat. No. 3,879,627 to Herman; U.S. Pat. No. Des. 299,680 to Ochsner each disclose various configurations for bibs and/or aprons.

In this respect, the bib for use while operating a vehicle according to the present invention substantially departs from the conventional concepts and designs of the prior art, and in so doing provides an apparatus primarily developed for the purpose of providing a bib for use while operating a vehicle.

Therefore, it can be appreciated that there exists a continuing need for new and improved bib for use while operating a vehicle which can be used for providing a bib for use while operating a vehicle. In this regard, the present invention substantially fulfills this need.

SUMMARY OF THE INVENTION

In view of the foregoing disadvantages inherent in the known types of aprons of various designs and configurations now present in the prior art, the present invention provides an improved bib for use while operating a vehicle. As such, the general purpose of the present invention, which will be described subsequently in greater detail, is to provide a new and improved bib for use while operating a vehicle apparatus and method which has all the advantages of the prior art and none of the disadvantages.

To attain this, the present invention essentially comprises a bib for use while operating a vehicle, the bib comprising, in combination, a plastic sheet having a first end with a first width and a second end with a second width and an intermediate extent with a third width. The width of the intermediate extent is greater than the width of the first and second ends. A first tubular opening is formed adjacent the first end. A second tubular opening is formed adjacent the second end. Indicia is formed on the sheet. A steering column ring is provided and has a first threaded end and a second threaded end and an intermediate extent therebetween. A first retaining ball is adapted to be threadably secured over the first end. A second retaining ball is adapted to be threadably secured over the second end. The intermediate extent of the ring is positioned within the first tubular opening of the sheet. The steering column ring is adapted to be positioned about a steering column of a vehicle with the first and second retaining balls securing the ring upon the steering column. A neck ring is also provided and has a first threaded end, a second threaded end and an intermediate extent therebetween. A first retaining ball is adapted to be threadably secured over the first end. A second retaining ball is adapted to be threadably secured over the second end. The intermediate extent is positioned within the second tubular opening of the plastic sheet. The neck ring is adapted to be positioned about the neck of a wearer with the first and second securing balls retaining the ring in place.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bib for use while operating a vehicle which has all the advantages of the prior art aprons of various designs and configurations and none of the disadvantages.

It is another object of the present invention to provide a new and improved bib for use while operating a vehicle which may be easily and efficiently manufactured and marketed.

It is a further object of the present invention to provide a new and improved bib for use while operating a vehicle which is of a durable and reliable construction.

An even further object of the present invention is to provide a new and improved bib for use while operating a vehicle which is susceptible of a low cost of manufacture with regard to both materials and labor, and which accordingly is then susceptible of low prices of sale to the consuming public, thereby making such aprons of various designs and configurations economically available to the buying public.

Still yet another object of the present invention is to provide a new and improved bib for use while operating a vehicle which provides in the apparatuses and methods of the prior art some of the advantages thereof, while simultaneously overcoming some of the disadvantages normally associated therewith.

Still another object of the present invention is to providing a bib for use while operating a vehicle.

Lastly, it is an object of the present invention to provide a bib. The bib is specifically adapted to be worn while an operator is controlling a vehicle. The device defines particular application while a use is eating and/or drinking while operating a vehicle. In its broadest context, the device includes a sheet of material having a first and a second end and an intermediate extent therebetween, wherein the intermediate extent is of a greater width than the first and second ends. Furthermore, a first steering column ring is adapted to be secured to the first end of the sheet while a neck ring is adapted to be secured adjacent the second end of the sheet. Thus, in operation, the user affixes the neck ring about the neck and the steering column ring about the steering column of a vehicle and thus employs the sheet as a bib.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
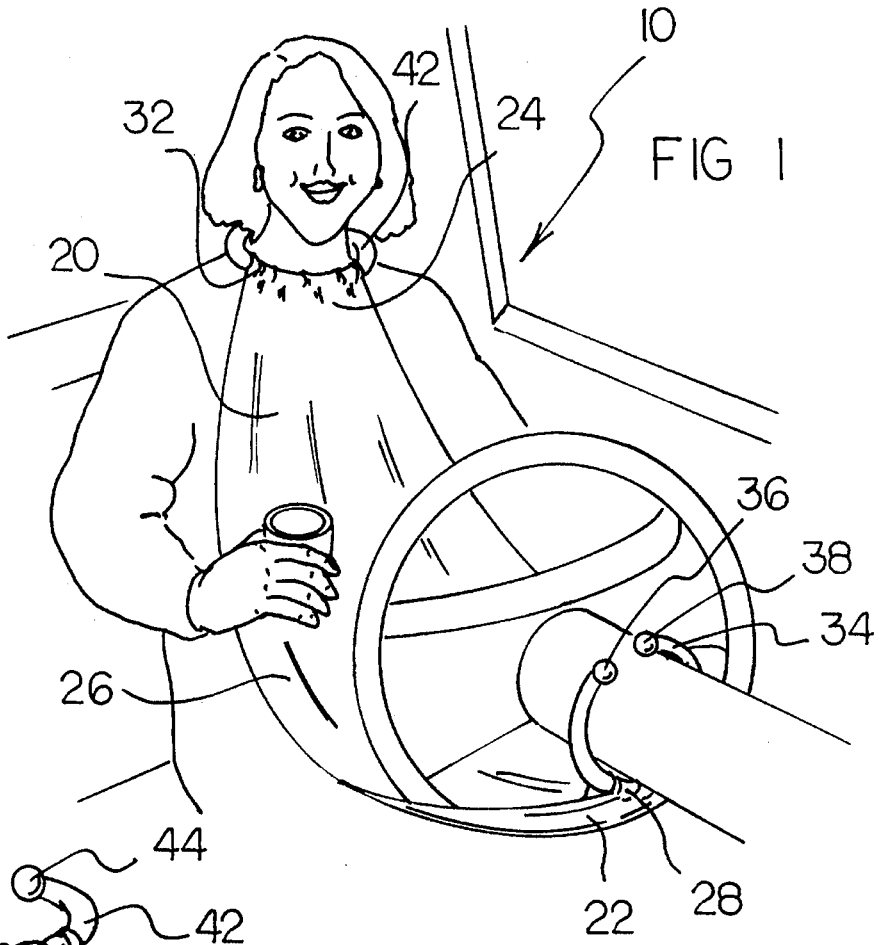
FIG. 1 is a perspective view of the bib in use.
Figure 2:
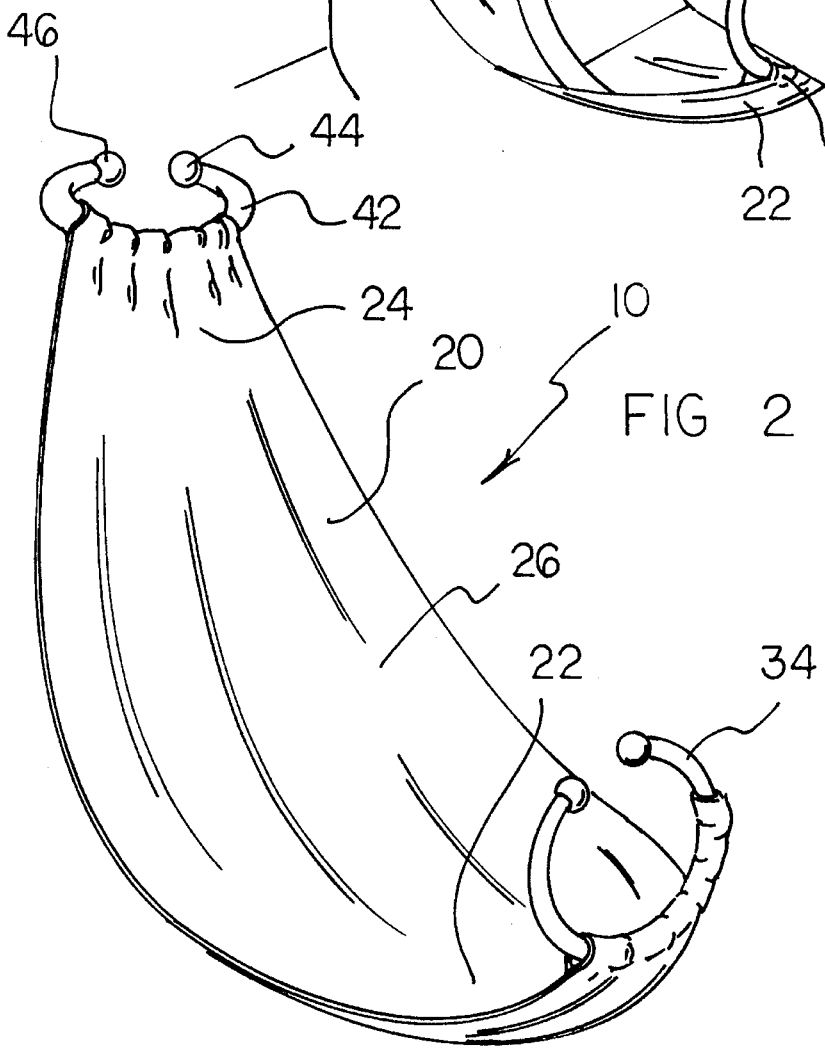
FIG. 2 is a perspective illustration of the bib.

With reference now to the drawings, and in particular to FIG. 1 thereof, a new and improved bib for use while operating a vehicle embodying the principles and concepts of the present invention and generally designated by the reference numeral 10 will be described.

The present invention relates to a bib. The bib is specifically adapted to be worn while an operator is controlling a vehicle. The device defines particular application while a use is eating and/or drinking while operating a vehicle. In its broadest context, the device includes a sheet of material having a first and a second end and an intermediate extent therebetween, wherein the intermediate extent is of a greater width than the first and second ends. Furthermore, a first steering column ring is adapted to be secured to the first end of the sheet while a neck ring is adapted to be secured adjacent the second end of the sheet. Thus, in operation, the user affixes the neck ring about the neck and the steering column ring about the steering column of a vehicle and thus employs the sheet as a bib.

Figure 3:
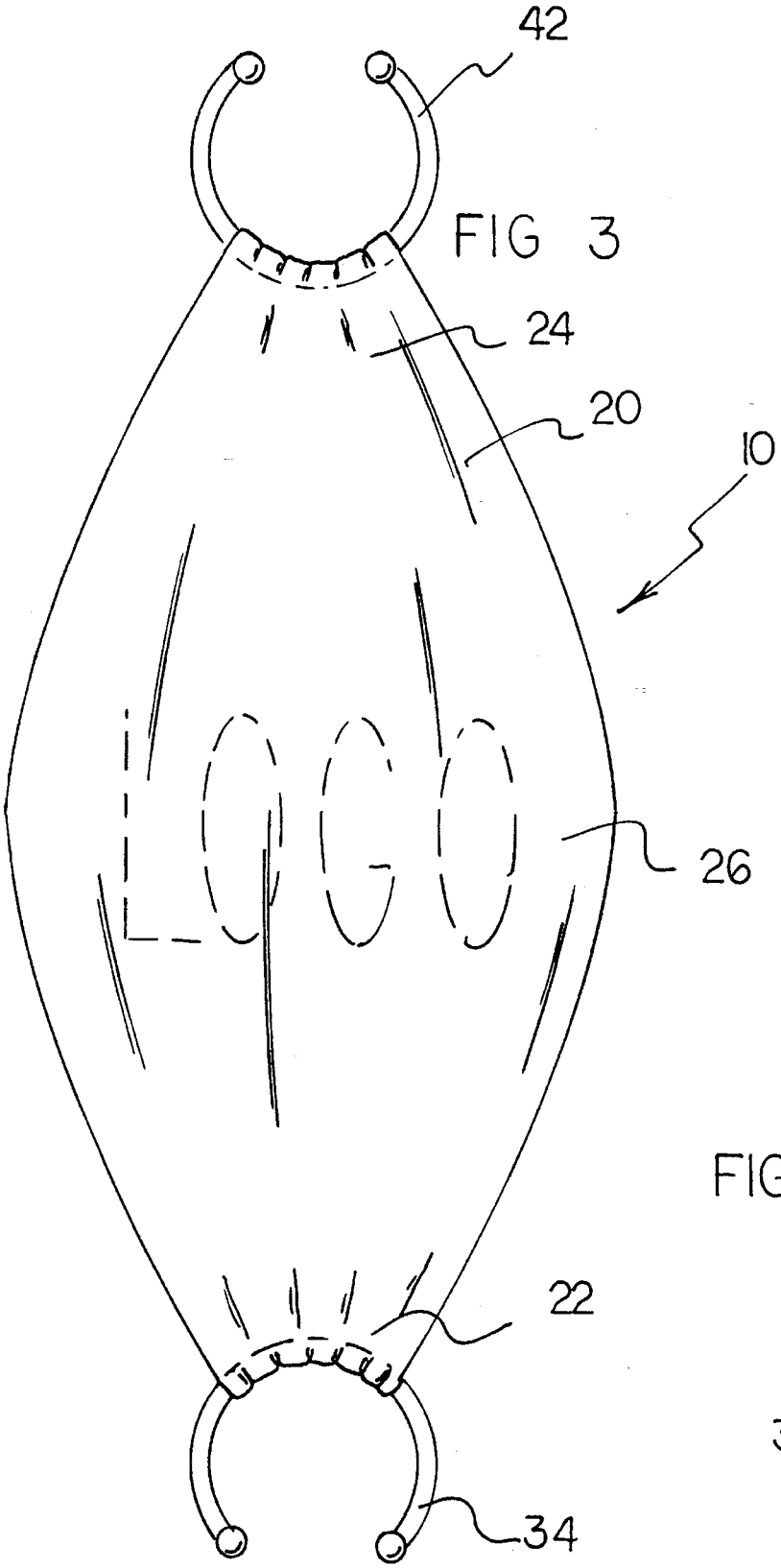
FIG. 3 is a plan view of the bib with an associated logo.
Figure 4:
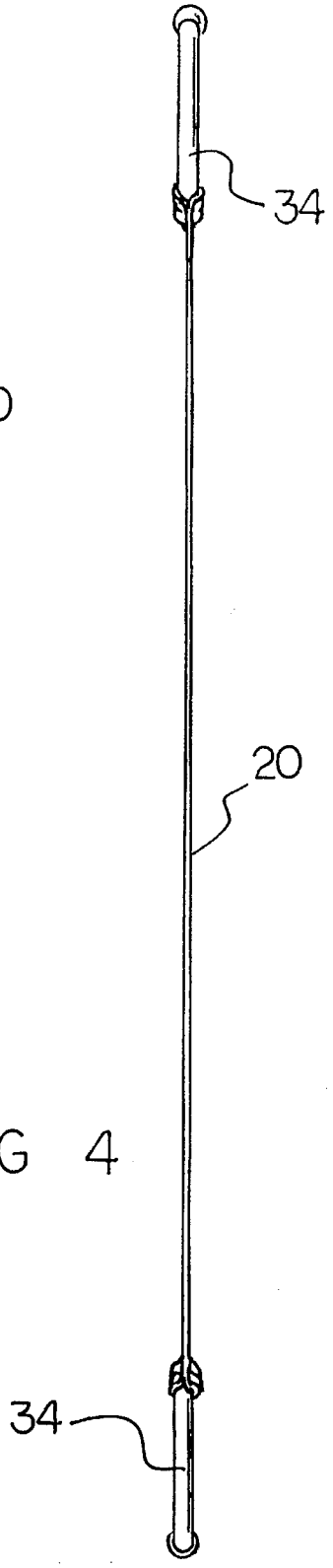
FIG. 4 is a side view of the bib in accordance with the present invention.
Figure 5:
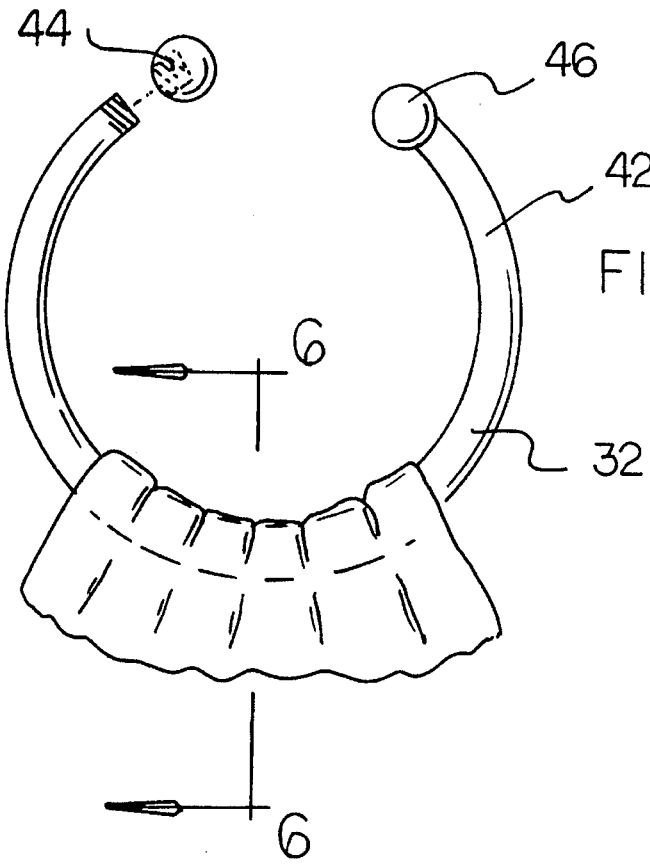
FIG. 5 is a view of one of the rings in accordance with the present invention.
Figure 6:
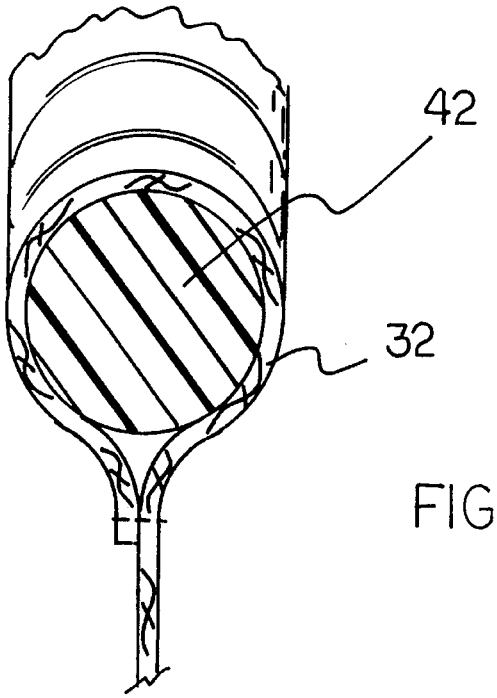
FIG. 6 is a view taken along line 6—6 of FIG. 5.

The plastic sheet 20 of the device 10 is defined by a first end 22, a second end 24 and an intermediate extent 26. Furthermore, the first end 22 is defined by a first width, the second end 24 is defined by a second width while the intermediate extent 26 is defined by a third width. In the preferred embodiment, the width of the intermediate extent 26 is greater than the width of the first and second ends 22 and 24 respectively. Furthermore, a first tubular opening 28 is formed adjacent the first end 22 of the sheet 20. Likewise, a second tubular opening 32 is formed adjacent the second end 24 of the sheet 20. These tubular openings can be formed as portions of the sheet which are folded over and stitched. The function of these tubular openings will be described in greater detail hereinafter. As illustrated in FIG. 3, indicia, which may take the form of a logo and/or Trademark, can be formed upon the sheet 20.

A steering column ring 34 is employed in securing one end of the device to the steering column of a vehicle. The steering column ring 34 is defined by a first threaded end and a second threaded end. Furthermore, the steering column ring 34 is defined by an intermediate extent. A first retaining ball 36 is adapted to be threadably secured over the first end of the ring 34, while a second retaining ball 38 is adapted to be threadably secured upon the second end of the ring 34. Furthermore, as can be seen in FIG. 1, the intermediate extent of the ring 34 is adapted to be positioned within the first tubular opening 28 of the sheet 20. In use, the steering column ring 34 is adapted to be secured about the steering column of a vehicle. In order to more securely affix the ring about the steering column, the first and second retaining balls 36 and 38 respectively, can be threadably secured over the first and second ends of the ring 34. Thus, in use, the ring can be positioned over the steering column without the retaining balls present. Then, in order to more securely fasten the ring 34 about the steering column the two retaining balls 36 and 38 can be screwed on to the two ends of the ring.

The neck ring 42 of the present invention is defined by a first threaded end, a second threaded end and an intermediate extent therebetween. As with the steering column ring 34 the neck ring 42 includes a first retaining ball 44 which is adapted to be threadably secured over the first end, and a second retaining ball 46 which is adapted to be threadably secured over the second end of the ring 42. Likewise, the intermediate extent of the ring 42 is positioned within the second tubular opening 32 of the plastic sheet 20. Thus, the neck ring 42 is adapted to be positioned about the neck of a wearer. Then, in order to gain a more secure attachment about the neck of a wearer, the first and second retaining balls can be threadably secured to the first and second ends of the neck ring.

However, in an alternate embodiment, each of the rings is constructed of a resilient material. Thus, the steering column ring 34 can be slightly deformed and fitted about the steering column of a vehicle. Likewise, the neck ring 42 can be slightly deformed and inserted over the neck of a wearer. In this embodiment, neither of the retaining balls are employed for use in securing either of the rings. Thus, in each instance, the inherent resilience of the rings is sufficient to secure about either the steering column or the neck of a wearer.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved bib for use while operating a vehicle, the bib comprising, in combination:

a plastic sheet having a first end with a first width and a second end with a second width and an intermediate extent with a third width, the width of the intermediate extent being greater than the width of the first and second ends, a first tubular opening formed adjacent the first end, a second tubular opening formed adjacent the second end, indicia formed upon the sheet;

a steering column ring having a first threaded end and a second threaded end and an intermediate extent therebetween, a first retaining ball adapted to be threadably secured over the first end, a second retaining ball adapted to be threadably secured over the second end, the intermediate extent of the ring positioned within the first tubular opening of the sheet, the steering column ring adapted to be positioned about a steering column of a vehicle with the first and second retaining balls securing the ring upon the steering column; and a neck ring having a first threaded end, a second threaded end and an intermediate extent therebetween, a first retaining ball adapted to be threadably secured over the first end, a second retaining ball adapted to be threadably secured over the second end, the intermediate extent positioned within the second tubular opening of the plastic sheet, the neck ring adapted to be positioned about the neck of a wearer with the first and second securing balls retaining the ring in place.

2. A bib for use while operating a vehicle, the bib comprising:

a plastic sheet having a first end with a first width and a second end with a second width and an intermediate extent with a third width, the width of the intermediate extent being greater than the width of the first and second ends, a first tubular opening formed adjacent the first end, a second tubular opening formed adjacent the second end;

a steering column ring having a first end and a second end and an intermediate extent therebetween, the intermediate extent of the ring positioned within the first tubular opening of the sheet, the steering column ring adapted to be positioned about a steering column of a vehicle; and a neck ring having a first end, a second end and an intermediate extent therebetween, the intermediate extent positioned within the second tubular opening of the plastic sheet, the neck ring adapted to be positioned about the neck of a wearer.

3. The device as set forth in claim 2 wherein indicia is formed upon the sheet.

4. The device as set forth in claim 2 wherein the first and second ends of the steering column ring are threaded and a first retaining ball is adapted to be threadably secured over the first end and a second retaining ball is adapted to be threadably secured over the second end and wherein the first and second ends of the neck ring are threaded and a first retaining ball is adapted to be threadably secured over the first end and a second retaining ball is adapted to be threadably secured over the second end.

* * * * *